US007251890B2

(12) United States Patent
Atts

(10) Patent No.: US 7,251,890 B2
(45) Date of Patent: Aug. 7, 2007

(54) METHOD FOR PRODUCING WHEEL PANS

(75) Inventor: Bruno Atts, Solingen (DE)

(73) Assignee: Michelin Kronprinz Werke GmbH, Solingen (DE)

( * ) Notice: Subject to any disclaimer, the term of this patent is extended or adjusted under 35 U.S.C. 154(b) by 468 days.

(21) Appl. No.: 10/832,869

(22) Filed: Apr. 27, 2004

(65) Prior Publication Data

US 2004/0239172 A1 Dec. 2, 2004

(30) Foreign Application Priority Data

Apr. 30, 2003 (DE) ..... 103 20 688

(51) Int. Cl.
*B23P 17/00* (2006.01)

(52) U.S. Cl. ..... 29/894.325; 29/894.354; 72/199; 72/203; 72/221

(58) Field of Classification Search ..... 29/894.325, 29/894.354; 72/199–252.5
See application file for complete search history.

(56) References Cited

U.S. PATENT DOCUMENTS 3,610,862 A * 10/1971 Erlandson ..... 219/67
4,660,754 A * 4/1987 Byrd ..... 228/151
7,124,609 B1 * 10/2006 Hermanson ..... 72/82

FOREIGN PATENT DOCUMENTS

DE 493 472 3/1930

* cited by examiner

*Primary Examiner*—Richard Chang
(74) *Attorney, Agent, or Firm*—Cohen Pontani Lieberman & Pavane LLP

(57) ABSTRACT

A method for producing a wheel pan includes cold-rolling a rectangular metal strip of a given uniform thickness by conical rolls into a semicircular ring, such that the thickness reduction on the outer edge of the curved strip is at least 20%, and the circumference of the semicircular ring thus produced extends 130-310°, preferably 180°; bending the semicircular ring into a complete circle to produce a conical hoop, welding the ends together; and shaping the hoop to form the bottom of the pan.

8 Claims, 2 Drawing Sheets

METHOD FOR PRODUCING WHEEL PANS

BACKGROUND OF THE INVENTION

1. Field of the Invention

The invention concerns a method for producing wheel pans for motor vehicle wheels.

2. Description of the Related Art

The production of wheel pans for motor vehicle wheels, i.e., the center web of a vehicle wheel, generally starts with sheet bars, which in turn are punched out or burned out of strip material or wide flat steel. This method of production generates a large amount of material scrap which can be as high as 35 to 40%.

To reduce this very large amount of material waste, various wheel manufacturers have tried to produce the wheel pans from cylindrical hoops. So far this has been successfully realized only with a very expensive 2-step orbital press-forming process.

In this production process, a cylindrical hoop is first produced, which is then shaped into a cup by orbital press forming. The bottom of the wheel pan is pre-shaped in a second orbital press-forming step. The wheel pan is then finished in the conventional way.

Since this process is mainly a material bulging process, very high forces are required and it can be realized only with very high capital expenditures.

DE Patent reference 493 472 describes another method, in which production begins with a flat bar, i.e., a rectangular strip, which is then tapered toward one edge and simultaneously rounded by rolling it between conical rolls. This results in the formation of an open circular ring, whose ends are then joined. The final shaping of the pan is then carried out in a pressing or drawing process.

SUMMARY OF THE INVENTION

An object of the present invention is to provide a production process for producing wheel pans for motor vehicle wheels which is simplified with respect to the prior art.

In accordance with the present invention, this objective is achieved by a method for producing a wheel pan including the following steps: cold-rolling a rectangular metal strip of a given uniform thickness by conical rolls into a semicircular ring, such that the thickness reduction on the outer edge of the curved strip is at least 20%, and the circumference of the semicircular ring has an extension in the range 130-310°, preferably 180°; bending the semicircular ring into a complete circle to produce a conical hoop, welding the ends together; and shaping the hoop to form the bottom of the wheel pan.

In the present application and claims, the term wheel pan refers to the center web of a motor vehicle wheel. In conventional wheel pan production, the round sheet bar is deformed in a flow-turning machine. In this process, the sides of the pan are conically stretched out (tapered) from the bottom (base) toward the edge. The reasons for the stretching are to reduce the weight of the part, and to strain-harden the material by cold-working.

In the method according to the invention, the tapering or the strain-hardening of the material is already achieved in the strip by the rolling which was done before the first shaping operation. The strip is lengthened along one side by conical rolls, so that an arc-shaped part is formed. However, an important difference from the state of the art is that the method of the invention does not produce a circular ring with a circumference of almost 360°, but rather a semicircular ring with a circumference extending only 130-310°, and preferably 180°.

The semicircular ring is then shaped into a closed ring, and this results at once in a conical hoop. Both the bottom of the pan and the sides can then be shaped from a hoop produced in this way by simple pressing operations. The reason that the bottom of the pan can be shaped so easily is that the area in question has already been pre-shaped. That is, when the strip was rolled between the conical rolls, the thickness of the material was reduced by 20-50% on the outer edge of the strip, the degree of reduction depending on the desired degree of deformation. Depending on this desired deformation, the circumference of the semicircular ring will be between 130° and 310°.

The remaining sequence of operations is the same as in the present production method.

The effect of the new method is material savings of approximately 38% compared to the methods presently practiced.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
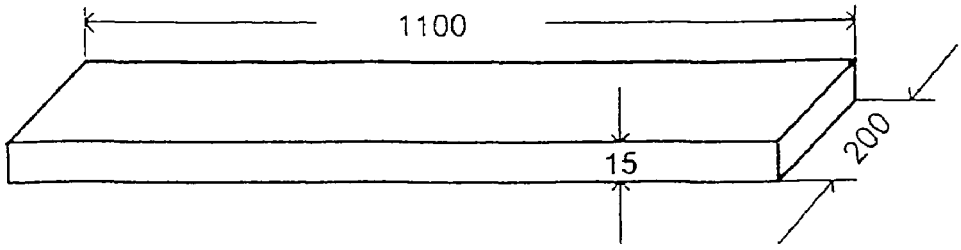
FIG. 1 is a perspective view of a rectangular section of strip.

The method according to the present invention is explained below with reference to a concrete example illustrated in the drawings. The production is described for a truck wheel pan with dimensions of 22.5 cm×9.00 cm. As shown in FIG. 1, the initial material is a section of strip taken from a coil or section of wide flat steel of the specified dimensions. The strip is conically rolled out by conical rolls into a strip and simultaneously shaped into an arc or semicircular ring. The conical rolling out of the material has the effect of making the outer curved edge of the strip (R=540 mm) longer than the inner curved edge of the strip (r=340 mm), which facilitates the bending of the strip into an arc.

Figures 2, 2A:
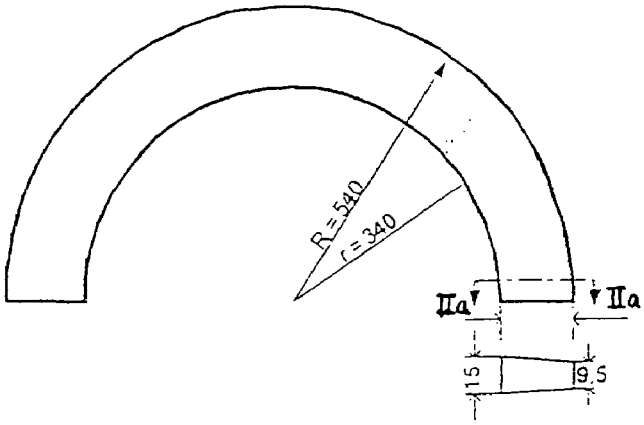
FIG. 2 is a plan view of the strip of FIG. 1 after it has undergone conical rolling.
FIG. 2*a* is a sectional view of the strip of FIG. 2.

The semicircular ring preferably has a circumference of 180°, but in any event it should be significantly less than 360° (FIG. 2).

Figure 3:
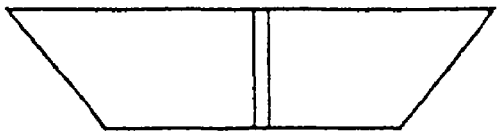
FIG. 3 is a side view of a conical hoop formed by the conically rolled strip of FIG. 2.

A conical hoop is now formed by bending the semicircular ring into a closed ring (see FIG. 3). The bending rolls of the circular form bending machine must be conically designed due to the different peripheral speeds at the inner and outer curved edges of the arc-shaped strip and must be arranged at a certain angle to each other.

Figure 4:
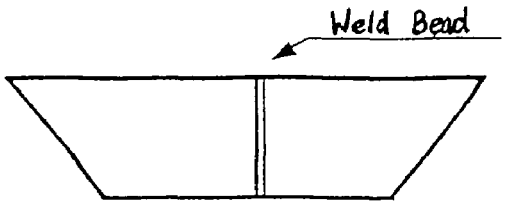
FIG. 4 is a side view of the conical hoop of FIG. 3 with a weld bead.

The welding (flash butt welding, DC pressure welding, or other welding methods) and the deburring and re-rounding of the parts are carried out as in standard wheel pan production (see FIG. 4).

Figure 5:
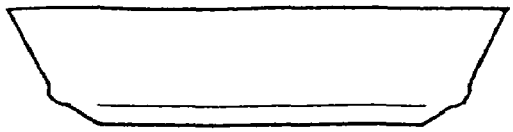
FIG. 5 is a side view of the conical hoop of FIG. 4 after a pressing operation.

The pan bottom is pre-pressed into the conical hoop in a press, and the radius between the bottom and the cup is adjusted to the desired final dimension (FIG. 5).

The beading of the pan bottom can be accomplished under a press or on a flow-turning machine.

Beading under a press can be carried out without significant problems, since the pan bottom has already been 30-60% pre-shaped by the production of the parts from a conical hoop.

The completion of the pan bottom on a flow-turning machine would bring about the additional effect of strain-hardening in this area and prolong the service life of the wheel. A reduction of the wall thickness of the initial material would be possible and would:

(a) reduce the weight of the part, and (b) further reduce the amount of material required.

The sides of the pan can be shaped by flow-turning (as before) or, due to the already conically rolled material in this area, by a simple pressing operation instead of the more expensive flow-turning method.

Figure 6:
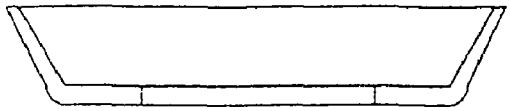
FIGS. 6-8 are sectional views of the conical hoop during the final steps of production.
Figure 7:
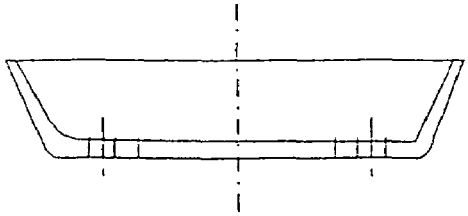
Figure 8:
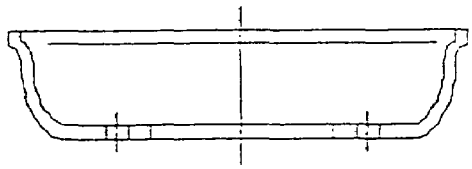

The remaining sequence of operations for completion of a wheel pan is the same as in conventional production sequences (FIGS. 6-8). In FIG. 6 the bottom of the cup-shaped pan is made flat. In FIG. 7 connection holes are made in the wheel pan. In FIG. 8, the sides of the wheel pan are shaped.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for producing a motor vehicle wheel pan, comprising the steps of:

cold-rolling a rectangular metal strip of a uniform thickness using conical rolls to form a semicircular ring, wherein the semicircular ring is a curved strip with an outer edge and an inner edge, a thickness of the curved strip at the outer edge of the curved strip is reduced by at least 20% relative to the uniform thickness of the metal strip, wherein the thickness of the curved strip decreases from the inner edge to the outer edge such that the thickness at the outer edge is less than the thickness at the inner edge, and a circumference of the semicircular ring extends in a range 130-310°;

producing a conical hoop from the semicircular ring by circular bending of the semicircular ring into a closed ring to form the conical hoop shape and welding the ends together; and shaping the conical hoop to form a bottom of the wheel pan.

2. The method of claim 1, wherein the conical hoop has a principal angle relative to the axis of symmetry of 20-70°.

3. The method of claim 1, wherein the step of cold-rolling produces no thickness reduction on the inner edge of the curved strip.

4. The method of claim 1, wherein the step of cold-rolling produces a reduction of the thickness of the curved strip on the inner edge that is less than 20%.

5. The method of claim 1, wherein said step of shaping includes producing a thickening of up to 30% on the inner edge of the strip.

6. The method of claim 1, wherein last deformations in said step of a shaping comprise flow turning or pressing the conical hoop.

7. The method of claim 1, wherein said step of cold rolling is carried out with two or more conical rolls.

8. The method of claim 1, wherein the semicircular strip produced by said step of cold-rolling extends approximately 180°.

* * * * *